US008898841B2

(12) United States Patent
Esch

(10) Patent No.: US 8,898,841 B2
(45) Date of Patent: Dec. 2, 2014

(54) ENCOUNTER AND CONTACT MATTRESS OR PILLOW FOR SMALL CHILDREN AND BABIES, PARTICULARLY FOR PREMATURE BABIES AND NEWBORNS

(76) Inventor: Barbara M. Esch, Zug (CH)

( * ) Notice: Subject to any disclaimer, the term of this patent is extended or adjusted under 35 U.S.C. 154(b) by 0 days.

(21) Appl. No.: 13/530,240

(22) Filed: Jun. 22, 2012

(65) Prior Publication Data

US 2013/0025062 A1 Jan. 31, 2013

Related U.S. Application Data

(63) Continuation of application No. PCT/IB2010/056038, filed on Dec. 22, 2010.

(30) Foreign Application Priority Data

Dec. 22, 2009 (DE) ..... 10 2009 059 285

(51) Int. Cl.
*A47G 9/02* (2006.01)

(52) U.S. Cl.
USPC ..... 5/655; 5/632

(58) Field of Classification Search
USPC ..... 5/655, 630, 632, 652
See application file for complete search history.

(56) References Cited

U.S. PATENT DOCUMENTS

| | | | | |
|---|---|---|---|---|
| 4,631,766 | A * | 12/1986 | Semmler et al. | 5/655 |
| 4,825,487 | A | 5/1989 | Eberl | |
| 5,048,136 | A | 9/1991 | Popitz | |
| 5,333,769 | A * | 8/1994 | Skroski | 224/158 |
| 5,341,531 | A | 8/1994 | Straub et al. | |
| 5,351,348 | A | 10/1994 | Beger | |
| 5,722,094 | A * | 3/1998 | Ruefer | 2/69.5 |
| 6,505,366 | B1 | 1/2003 | Lied | |
| 2008/0256679 | A1 | 10/2008 | White | |

FOREIGN PATENT DOCUMENTS

| | | |
|---|---|---|
| DE | 35 02 003 | 7/1986 |
| DE | 39 10 238 | 3/1990 |
| DE | 199 093 82 | 9/2000 |
| DE | 699 11 426 | 7/2004 |
| DE | 10 2008 059 469 | 6/2009 |
| DE | 20 2010 017 308 | 1/2012 |
| DE | 10 2010 061 510 | 6/2012 |
| EP | 0 188 739 | 7/1986 |

(Continued)

OTHER PUBLICATIONS

International Search Report of PCT/IB2010/056038, May 26, 2011.

(Continued)

*Primary Examiner* — Fredrick Conley
(74) *Attorney, Agent, or Firm* — Collard & Roe, P.C.

(57) ABSTRACT

An encounter and contact mattress or pillow, is made up of at least one cloth-like or blanket-like base body having two functional sides that are configured to be the same, similar, or different, and serve for support, wherein the one side is suitable for facing toward a contact person and the other side is suitable for offering a premature or newborn baby or infant a support surface. The base body is divided up into at least three regions, namely into an edge zone region (8), a transition region (6), and an encounter region (5), and the encounter region (5) is configured in such a manner that a transfer of tactile and/or acoustic stimuli and/or heat from one side to the other side of the encounter and contact mattress (1) is possible.

11 Claims, 20 Drawing Sheets

(56) References Cited

FOREIGN PATENT DOCUMENTS

| | | |
|---|---|---|
| EP | 0 503 231 | 9/1992 |
| EP | 1 795 090 | 6/2007 |
| EP | 1 864 630 | 12/2007 |

OTHER PUBLICATIONS

German Search Report dated Sep. 27, 2010 in German Application No. 10 2009 059 285.7 with English translation of the relevant parts.

* cited by examiner

ENCOUNTER AND CONTACT MATTRESS OR PILLOW FOR SMALL CHILDREN AND BABIES, PARTICULARLY FOR PREMATURE BABIES AND NEWBORNS

CROSS REFERENCE TO RELATED APPLICATIONS

Applicant claims priority under 35 U.S.C. §119 of German Application No. 10 2009 059 285.7 filed on Dec. 22, 2009. This application is also a continuation of and Applicant claims priority under 35 U.S.C. §120 of International Application No. PCT/IB2010/056038 filed on Dec. 22, 2010, which claims priority under 35 U.S.C. 119 of German Application No. 10 2009 059 285.7 filed on Dec. 22, 2009. The international application under PCT article 21(2) was not published in English. The disclosure of the aforesaid International Application and German application are incorporated by reference.

BACKGROUND OF THE INVENTION

1. Field of the Invention

The invention relates to an encounter and contact mattress. The mattress has the property that it has two (or more) functional sides that are configured to be the same, similar, or different, and serve for support, whereby the one side is suitable for facing toward a contact person and another side is suitable for offering a baby a secure and comfortable support surface.

2. State of the Art

Within the scope of hospital treatment, particularly within the scope of intensive-care treatment of babies, particularly of premature babies, extended phases of separation of the child from the mother occur. This not only has negative consequences for the physical and psychological development of the child, but also leads to psychological suffering on the part of the mother and to a disruption in establishing the relationship between mother and child, with numerous negative consequences and uncertainties, which further complicate the already difficult situation.

For the initial phase of treatment of a premature baby, which is often critical and is primarily directed at survival of the child, and also for the treatment of very premature or sick children, the use of baby incubators, reanimation units, and heating beds has proven and established itself for maintaining the climate that is necessary for life.

In order to balance out the lack of true contact with the mother, the Kangaroo Care method is used, for example, in which the child is taken out of the incubator or heating bed for a few hours a day, and given to the mother or another caregiver (for the sake of simplicity, we will always say mother in the following) to lie on the mother's chest, in a position that is soothing for the child. The method of Kangaroo Care leads to an improvement in the bond between mother and child, and, as numerous studies have shown, contributes to positive development of premature babies.

The incubators that are part of the current state of the art have the following characteristics: This is an apparatus for accommodating a baby or a premature baby, whereby this apparatus is closed off toward the top. The upper region is configured as a hood and consists predominantly of transparent material. Reach-in openings on the side(s) and the ability to flip the top and sides open serve to perform the necessary care of the child and medical treatments. The size of such an incubator is defined so that not only can the child be accommodated in the incubator, but it can also be handled within the incubator, and additional surfaces for laying objects down are present.

Incubators are designed in such a manner that they have apparatuses that make a constant, moist/warm climate available within the incubator.

Warm and moist air is introduced into the interior of the incubator by way of ventilation slits. Positioning aids for babies are known in various embodiments.

The support surfaces or supports or positioning apparatuses usually used in baby incubators, reanimation units, and heating beds, for supporting premature and newborn babies, offer the child a support surface in the horizontal position (with the possibility of a change in position controlled by way of an electric motor, in infinitely adjustable manner). By means of this positioning, optimal access for medical care and general care of the child is made possible.

Added specially disposed mattresses, pillows, and constructions are intended to give the child (who can assume a great number of positions, without experiencing support, security, or comfortable positioning) security in its positioning. The individual positioning pillows are positioned accordingly, depending on their application, and generally simply lie on the positioning apparatus, for example a usual mattress.

On some support surfaces or cushions, the child lies directly on these, while others require an additional soft layer or wrapper, for example a molleton fabric or a surface structured in a particular manner, made of materials having low heat conductivity, or the support surfaces are heated to body temperature, in order not to take any heat away from the child, and to minimize unintentional air flows in the incubator.

The stated positioning aids have proven themselves as usual equipment to support the lying positions of the infants.

A typically used embodiment of a positioning mat for newborns is described in DE 199 093 82 A1. It consists of a pillow filled with polyurethane gel and enclosed, all around, by a plastic wrapper. The top has a regular peak and valley structure, whereby liquid collects in the valley structure, which thereby is not supposed to come into contact with the infant.

A cushion for positioning newborns in an incubator, bordered by film, is shown in the patent document DE 699 11 426 T2. This support surface has one or more chambers that can be filled with air and are partly covered with fabric. The hardness of the support surface can be individually adjusted by way of the filling pressure.

In patent document DE 39 10 238 A1, a special form of an inflatable air cushion having a surface that reinforces the effect of phototherapy is described.

More recent positioning mattresses and pillows for newborns consist of a viscoelastic, very soft foam material wrapped in plastic film, which gives way to the low weight pressure of the newborn.

Also more recent embodiments provide that such a support surface is combined with a heating film, in order to keep a corresponding temperature level stable over the entire mattress in this manner. In general, materials are used that have been dermatologically tested, are easy to clean and not flammable; in individual cases, they are also provided with an antibacterial property.

Aids for defined positioning on such a support surface are known in various embodiments. The positioning aids serve for lateral delimitation, for delimitation of the head, or also for positioning on the abdomen.

Aside from the usual practical positioning aids, such as, for example, a rolled-up molleton cloth, diaper, or the like, a number of very helpful products are on the market (for example positioning pillows made of gel, or support surfaces made of fabric, which impart a hold by means of sewn-on folds and fabric strips) within the scope of development-promoting care.

Positioning aids made of foam material with a somewhat harder surrounding plastic film, such as those used for abdominal positioning of the baby, are cut on the lower surface or at another corresponding suitable location, in order to allow compressed air that comes about by the contact pressure of the infant to escape, so that the mattress continues to demonstrate viscoelastic properties even in the greatly compressed state.

Furthermore, wedge-like configurations for avoiding cranial deformities, as listed in EP 1 795 090 A1, are known, as is a positioning device for newborns, intended for transport, from DE 35 02 003 A1. The latter consists of an elastically deformable silicone rubber and has a trough-like positioning aid for the head of the child. In this device, the child is positioned securely, softly, in heat-stable and slip-resistant manner, for transport.

A preemie cocoon is known from DE 10 2008 059 469 A1, which is particularly intended to be put on premature babies in incubators.

This is a kind of suit in the configuration of a wrapper that brings the premature baby into a suitable position, but also offers wrapper-like protection, comparable to a cocoon. If skin contact with the premature baby is desired, a few buttons and loops must be opened. In general, only the torso of the premature baby can be reached. In this connection, there is not fixed position of the child.

From US 2008/0256679 A1, an article of clothing for an adult person is known, which is suitable for being additionally provided with an article of clothing that is suitable for accommodating an infant, whereby the article of clothing for the infant can be affixed to that of the adult, in releasable manner. In this connection, no direct body contact is provided.

From EP 0 503 231 A1, a pad for an infant is known. This patent describes a preferably cushioned bottom part and an edge region at least partly filled with fill material.

From U.S. Pat. No. 5,341,531, a pad for an infant is known, in which the laterally cushioned edge regions, for example in wedge shape, can be removed.

DISADVANTAGES OF THE STATE OF THE ART

The positioning mattresses known from the state of the art generally have only one functional side, namely the side that faces the child.

This side is suitable for making a secure and heat-stable support surface available to the child, in different positions.

Beyond that, it is configured in such a manner so that liquids are kept away from the body of the child, in order to thereby avoid consequential harm. The back side is often identical with the functional side, and does not have any special apparatuses. Furthermore, devices are provided that allow a constant temperature level over the entire support surface.

The known positioning mattresses are equipped with all or a plurality of these positive properties, but do not have any kind of apparatuses by means of which the separation of the child from the mother could be cancelled out or bridged.

Use of the Kangaroo Care method requires complicated re-positioning of the child, who can often be transported only in restricted manner, due to respiration and infusion tubes, and a transfer to the position on the chest of the mother, who is usually sitting next to the incubator. In this connection, assistance by one or more nurses is required. The great expenditure of time and personnel limits use of the method to normal visiting hours, for example.

Furthermore, the Kangaroo Care method is used only late in the course of treatment, and not at all for severely ill children. However, more intensive support by the mother would be desirable specifically in these cases.

SUMMARY OF THE INVENTION

The task of the invention consists in making available an encounter and contact mattress that not only offers the function of stable, secure, and comfortable positioning of the newborn, but also offers the possibility of creating an encounter of mother and child, under natural conditions, without time restrictions. This is supposed to be made possible in simple manner, and also less intensively in terms of time and personnel, in comparison with the state of the art.

The solution for the task is presented in the characteristics of the encounter and contact mattress or pillow according to the invention. Multiple further developments of the invention are discussed below.

ADVANTAGES OF THE INVENTION

The encounter and contact mattress according to the invention, or the encounter and contact pillow, is divided into three regions, namely into edge zones, transition zones, and the encounter zone or contact zone. The mattress can be configured both with a stand-alone function and as a component of an incubator or heating bed, whereby it then replaces the conventional mattress.

However, if it is necessary for a specific micro-climate to be made available for the baby, the encounter and contact mattress has a hood that encloses the baby. In general, this hood consists of a flexible material and can be set up and taken down in the manner of a tent. By means of this hood, a specific climate can be maintained around the baby, also in the support and/or transport state.

One of the significant advantages of the invention consists in that the encounter and contact mattress allows and promotes a lasting encounter and the natural exchange between mother and child in that it makes available positioning that is secure and comfortable for mother and child.

However, the encounter and contact mattress can have not just a mattress-like configuration, but can also be configured as a pillow or pillow-like structure.

The encounter and contact mattress can be used in different functional contexts.

For one thing, it serves as a simple mattress that can be laid onto the body of the mother, for example, so that the child is positioned in secure, stable, and comfortable manner, but can also make physical contact with the mother, comparable to the Kangaroo Care method. Skin-to-skin contact can be achieved in simple manner, by way of through-openings in the encounter and contact mattress.

As in the case of Kangaroo Care, physiological processes in the mother (for example the release of bonding hormones and well-being, by means of odors and tactile stimuli) and maturation and development of the baby are stimulated here, as well.

The encounter and contact mattress can also be tied into the mother's bed and also into clothing and carrying systems. It is a fixed or replaceable part of this apparatus, in each instance, and can be configured in accordance with the requirements of the method of use and function, in each instance.

These particular embodiments permit an expansion of use, for example of the Kangaroo Care method, to everyday situations, but also all the way to the treatment of severely ill babies, who were not able to experience the benefits of support from the mother until now, or not so soon, and to yet other areas of application that are not mentioned here.

In advantageous manner, all possible materials known according to the state of the art, or a combination of them, or also new and newly developed materials, can be used for construction of the encounter and contact mattress or the encounter and contact pillow, in order to achieve the defined functions and properties. Occasionally, known materials are used and processed in simple manner. In some cases, an intended property or function, such as the distribution of weight or the removal of liquids, is already achieved solely by means of the special shape or structure (for example a surface having grooves or having another kind of surface structure worked into it).

The encounter and contact mattress can be used in many different embodiments. Aside from the mattress and pillow shape, it can also be used as a blanket, as an integrative or interchangeable component of an article of clothing or carrying element, of a hanging mattress, or as a part of the aforementioned structures, or of articles of clothing and objects not explicitly mentioned here.

These advantageous embodiments are described in the following exemplary embodiments.

BRIEF DESCRIPTION OF THE DRAWINGS

The invention is shown in different embodiments and in drawings.

These show.

DETAILED DESCRIPTION OF PREFERRED EMBODIMENTS

Principles of the Encounter Zone

The basic idea of the invention is to allow a natural encounter between mother and child, particularly one designed for a longer period of time, in that safe and comfortable positioning is made available both for the mother and for the child.

The encounter and contact mattress 1 or the encounter and contact pillow has not only the actual positioning surface, but also a specifically configured side for the contact person 3 and a specifically configured side for the child 2. The encounter region 5, which is configured predominantly in the manner of a mattress or mat or cloth, is disposed between the two sides.

Figure 1:
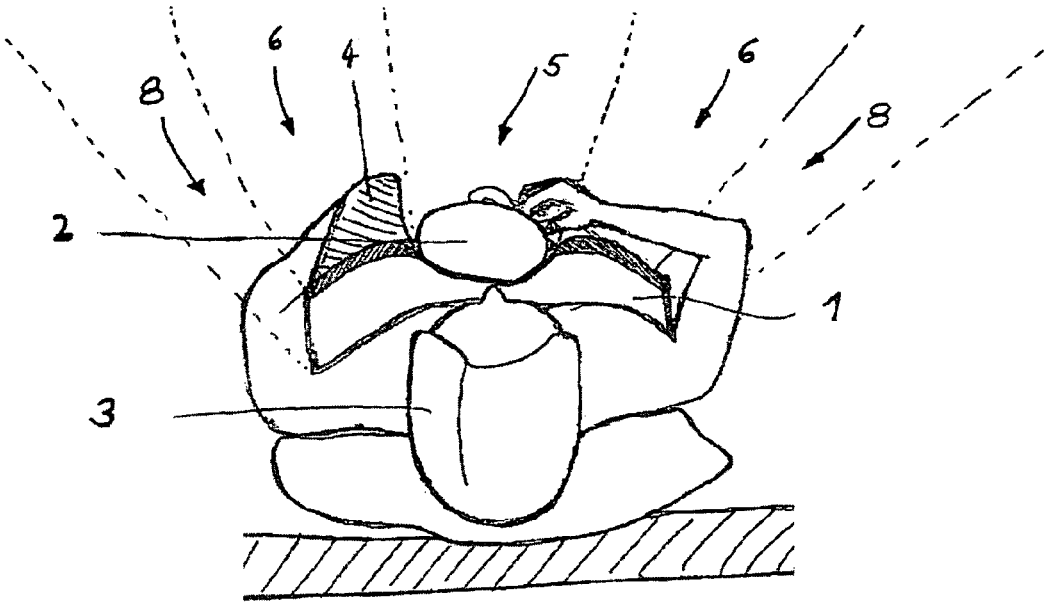
FIG. 1 a schematic view of the encounter and contact mattress in use.
Figure 2:
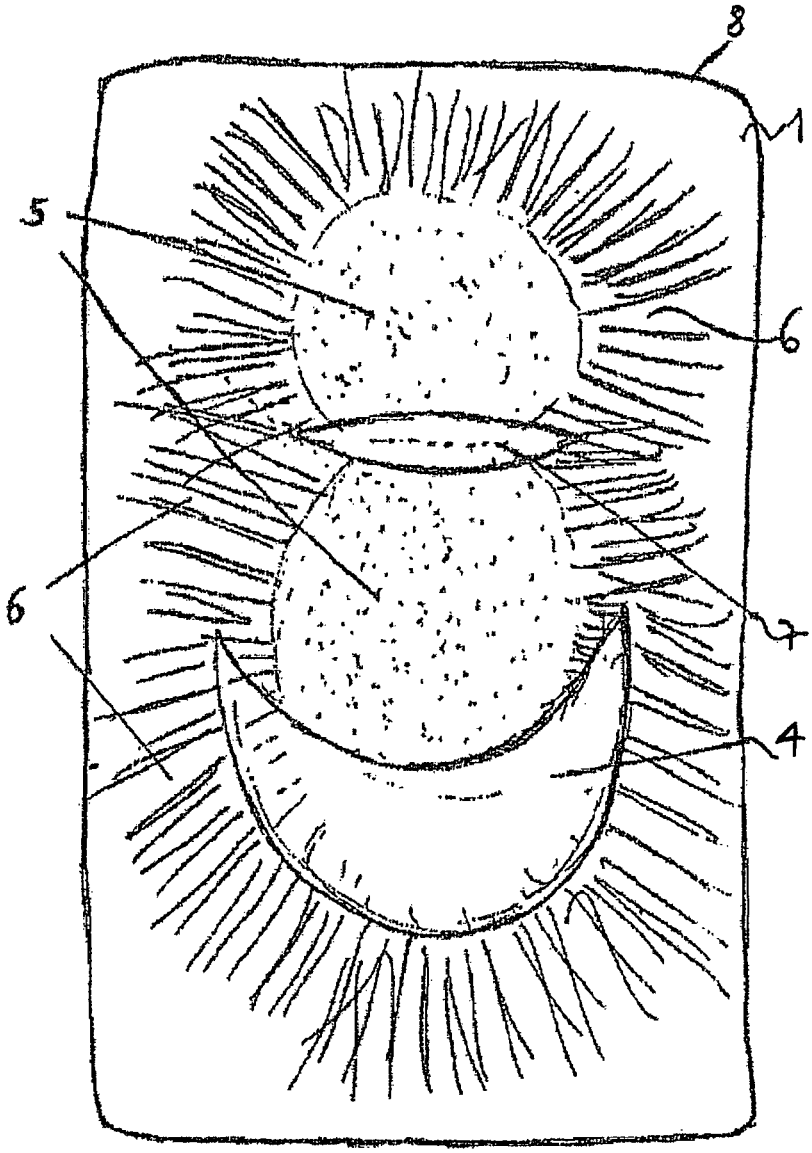
FIG. 2 a top view of the encounter and contact mattress, from the side of the child.

The encounter and contact mattress 1 has essentially three regions, as shown, for example, in FIGS. 1 and 2. Aside from the encounter zone 5, a transition zone 6 as well as edge zones 8 are provided.

In the case of a simple embodiment, it could be that the two sides do not differ, for example in the case of a very permeable contact surface, for example structured with films, or a very large through-opening in the region of the contact mattress. The films can consist of fabric, plastic, or a mixture or a combination of the two, or with other materials, and can be configured in net-like manner, for example.

It would also be possible that the encounter and contact mattress 1 is configured in wedge shape, for example, in other words with 5 sides, or also in cube shape, in other words with 6 sides. It could also be structured in spherical shape, oval or in some other manner, whereby the sides, in this case, are flexibly formed and defined only by means of the weight caused by the child lying on it.

Thus, a structure with sides facing two or more children (for example twins) and one side facing the contact person, opposite them, would also be possible, as would a structure with a support surface for one child (or again, for two and more) and with two sides facing the contact persons (for example the parents).

The encounter region 5 as described is configured as needed, (FIG. 3[A]-[E]), predominantly in such a manner that an encounter in the sense of the Kangaroo Care method, between an adult contact person 3 and predominantly a baby 2 takes place, and, if applicable, the transfer of tactile stimuli, acoustical signals, and possibly of odors or also of heat is possible. The region that mediates the encounter can also be configured to be permeable or impermeable to air, moisture, or germs, depending on the embodiment form and the requirements. For this purpose, different materials are known from the state of the art, which can be inserted into the encounter region 5 of the mattress 1. Preferably, these should be sewn in. However, gluing is also possible. An alternative could consist in that the films are replaceable in the encounter regions, and can be fixed in place on the remainder of the mattress by way of hook-and-loop closures, for example.

Another basic idea of the invention is to configure the encounter zone 5 in such a manner that the baby lies in soft and secure manner, and is held in the desired position by means of positioning aids 4, if necessary, and is secured to prevent unintentional slipping by means of an attachment system, if necessary. Particular protection of the head of the child appears to be important due its greater mobility.

The side of the encounter zone 5 that faces the contact person 3 is supposed to be configured to be sufficiently large, comfortable, and convenient so that the position can be maintained over an extended period of time, without effort and with pleasure.

If a film or a pillow covers the skin for an extended period of time, and if the skin is actually sealed off from the air, physical lack of well-being occurs. Perspiration on the skin leads to inflammation of the skin, and an overly long effect of pressure, even if it is caused by the body's own weight, leads to bedsores.

If there is an air-tight barrier between the contact person and the child, the surfaces that are in direct contact with the skin are configured, in terms of structure and material properties, in such a manner that good ventilation exists and comfortable positioning, designed for an extended period of time, is possible. For this purpose, grooves, also peak and valley structures of the surface are provided, or it consists predominantly of breathable material or itself contains other mechanisms that ensure ventilation of the skin and removal of liquids.

An alternative embodiment provides for attaching the encounter zone on the contact person in such a manner, for example with special adhesive surfaces on the skin, or integrating it into an article of clothing, for example into a T-shirt or patient care shirt, in such a manner that the encounter surface cannot slip away if the contact person falls asleep or suddenly wakes up, for example.

The contact and encounter mattress or the entire configuration is light and should be hardly felt by the contact person; optimally, the contact person experiences exclusively the weight of the child itself.

By means of direct and close positioning on the contact person, for example only by way of the intermediary of a film, a fabric, or woven textile, this can serve as the best of the positioning cushions made by nature, which furthermore moves with the rhythm of respiration, transmits the familiar heart tones to the child, and speaks with the child in the manner to which it is accustomed.

The encounter zone 5 according to the invention can be configured very differently, in terms of shape and material used, depending on the needs, as shown in FIGS. 1 to 5. It can be manufactured in one piece (for example from silicone rubber or another material). It can consist of different layers and plies of materials; it can contain through-openings and firmly affixed or removable positioning aids and devices for protecting the child or fastening it on the mattress.

A first exemplary embodiment—shown in FIGS. 1-4—of an encounter zone 5 consists of the flat configuration of a membrane or film that is interrupted by a through-opening 7 in the support surface of the child 2, and thereby allows positioning of contact person 3 and child 2 with skin-to-skin contact, as in the Kangaroo Care method, or only a very thin or interrupted barrier (such as, for example, a thin film or a net-like fabric) is provided.

While the direct encounter zone is predominantly configured to be as thin as possible here, or with through-openings, the surrounding zone contains additional functions, such as the absorption or removal of moisture, or the attachment of positioning aids and fixation systems.

With the more recent technical possibilities, one could, for example, produce films for this application that have the desired material properties, for example films that are particularly thin, are comfortable for skin contact, and, at the same time, are tear-resistant, by means of bonding multiple physiologically safe films to one another.

Preferably, a microscopically small peak and valley structure or an analogous embossing is proposed, on which droplet formation or water accumulation is not possible, due to the surface structure. The surrounding zone is predominantly configured in such a manner that removal of moisture radially to the outside is possible.

Likewise, it is provided that the layer from child 2 toward contact person 3 is configured to be permeable or porous, so that liquid that might have accumulated underneath the child, on the support surface, is conveyed away by way of an equalization system on the side facing the contact person.

Figures 3A, 3B, 3C, 3D, 3E, 3F:
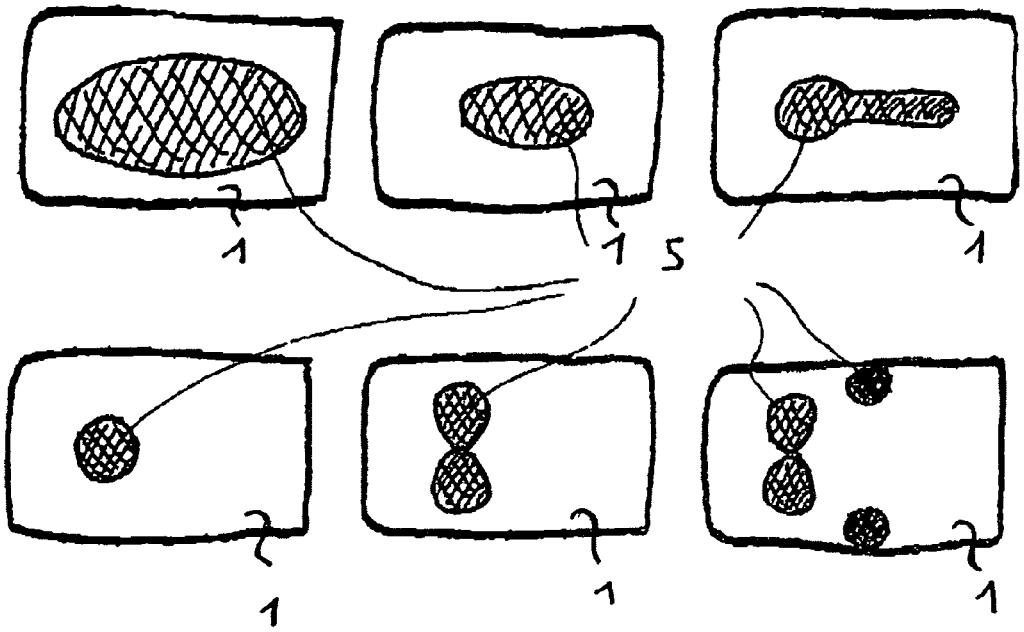
FIG. 3 [A-F] different embodiments of the encounter and contact mattress, with different configurations of the support surfaces.
Figure 4:
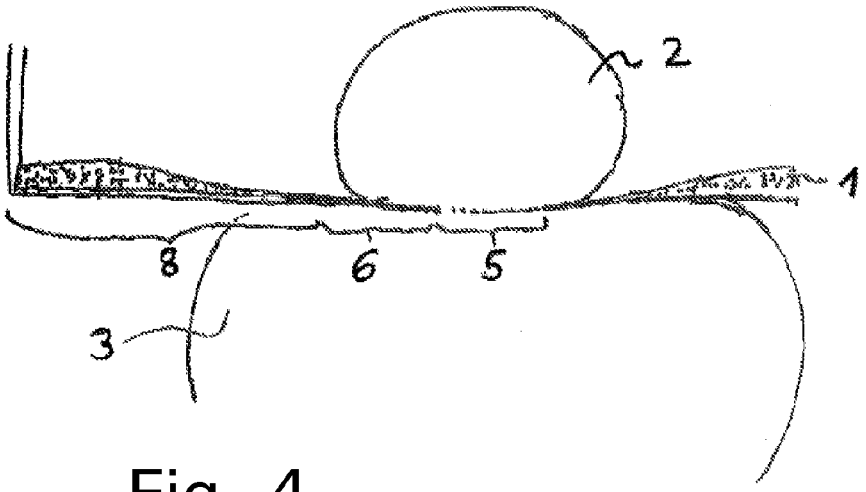
FIG. 4 a representation of the principle of a special use of the encounter and contact mattress.

FIG. 3 shows the shape variants for recesses or particularly permeable regions of the encounter mattress 1 in a top view.

If comfortable positioning of the child on the encounter mattress is supposed to take place for an extended period of time, a chambered mattress, predominantly filled with a gel or a viscous liquid, or a mattress made of viscoelastic foam material would be advantageous (as they are used in incubators, in bedsore therapy and prevention).

A further development of an encounter and contact mattress filled with gel or viscous liquid preferably consists of a mattress filled with gel, having a wrapper with different areas of softness. The positioning aids ensure stable positioning of the child on the mattress.

Figure 6A:
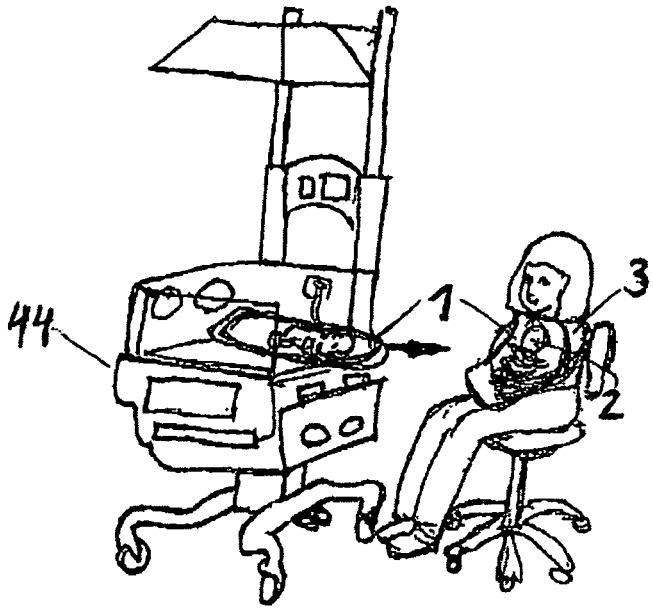
FIG. 6 [A-B] examples of the use of a previously shown of the encounter and contact mattress, as a mattress that can be removed from an incubator (A), and a mattress in a holder, with which the child can be moved from a heating bed to the contact person.
Figure 6B:
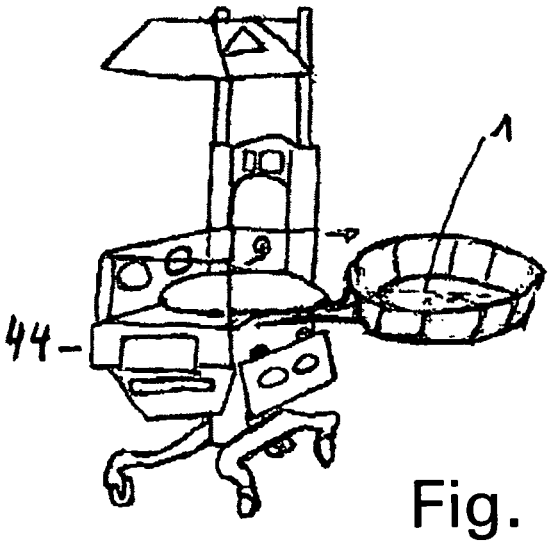

Such and other embodiments of the encounter and contact mattress 1 could be used well as a support mattress in an incubator, as shown in FIG. 6[A-B]. In this connection, the child could be taken out of the device by means of another side flap to be opened, and could be brought to the contact person 3 for the Kangaroo Care method, with all the existing connectors and cable connections, with the encounter and contact mattress 1 or also only with individual layers or parts of the mattress.

Figure 5A:
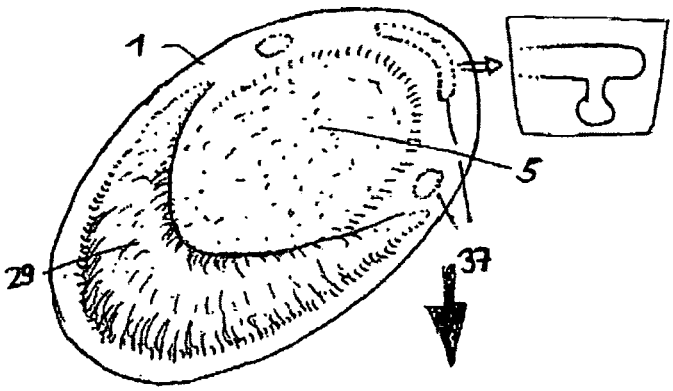
FIG. 5 [A-B] another embodiment of the encounter and contact mattress.
Figure 5B:
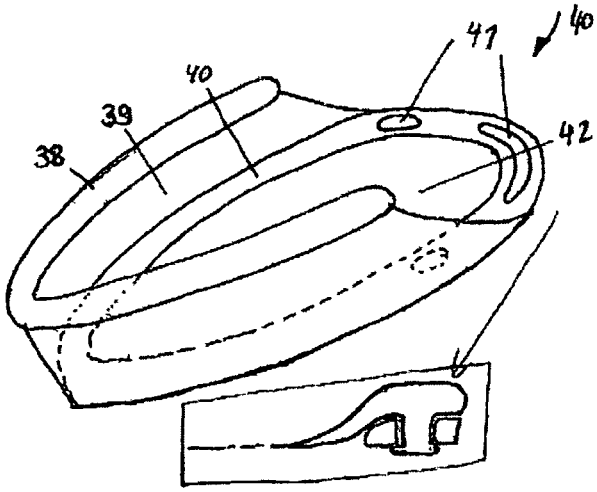

An encounter mattress made of an elastomer as shown in FIG. 5[A-B] could be affixed to a stabilizing frame, with precise fit, thereby increasing the strength and transport capability of the mattress. Such a mattress 1 could be used in an incubator, heating bed, or for transport, as a removable mattress.

Another embodiment, as shown in FIG. [5 B], provides for providing the contact mattress 1, as shown in FIG. [5 A], with a protective element 40, whereby the contact mattress 1 according to FIG. [5 A] has attachment elements 37 that can be inserted into recesses 41 of the protective element 40. The protective element 40 comprises an at least partial surrounding protective border 39, which consists of an elastomer. Thus, this offers the infant corresponding protection, it is held and also, corresponding drafts are deflected. A circumferential cushion ring 38 offers additional protection.

An encounter mattress 1 provides that a bead is laid around the contact and encounter zone, so that an encounter mattress integrated into a cloth is formed, which can simply be laid over the abdomen of the contact person 3. In this way, it is prevented that the preemie (baby) 2 can move out of the encounter and contact zone. In this connection, the contact person can therefore enjoy kangarooing, in very relaxed manner.

According to FIG. 6, an incubator 44 is shown, for example, which is provided with such an encounter and contact mat. In this way it is possible that the child or a baby, together with the contact mattress 1, can be removed from the incubator and brought to the body of the contact person 3, without the corresponding cables, which serve for electronic monitoring, having to be removed. A simpler form for implementing this is shown in FIG. [6 B]. Here, the encounter and contact mattress 1 is guided out of the incubator in the manner of a pan, and brought to the contact person either directly or indirectly.

Figure 7A:
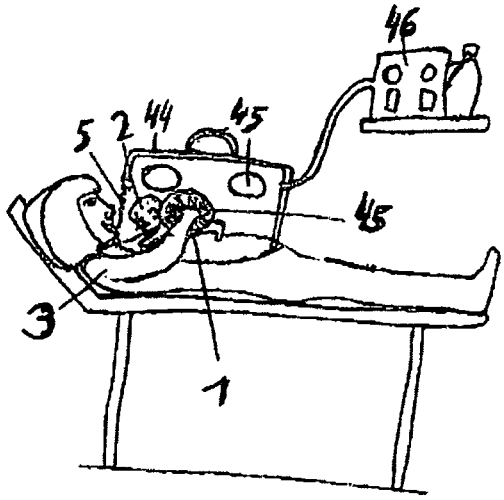
FIG. 7 [A-B] two further uses of previously shown encounter and contact mattresses, under a hood and in an incubator, respectively.
Figure 7B:
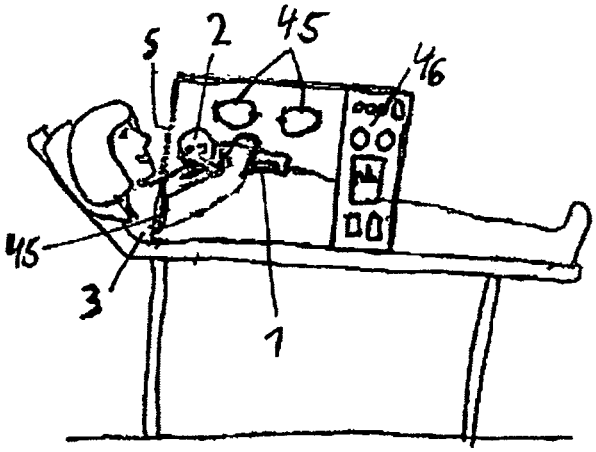
Figure 8A:
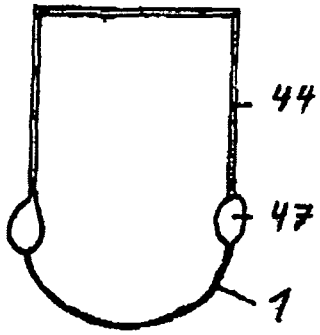
FIG. 8 [A-D] an embodiment of an incubator with an integrated encounter and contact mattress.
Figure 8B:
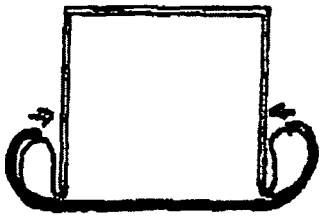
Figure 8C:
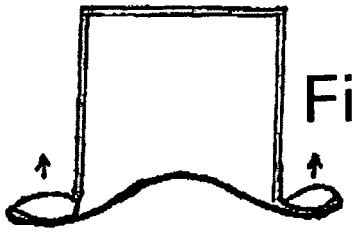
Figure 8D:
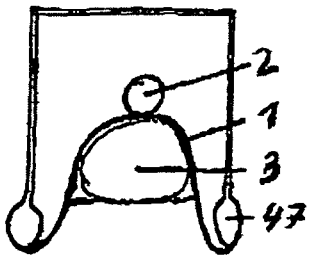
Figure 9A:
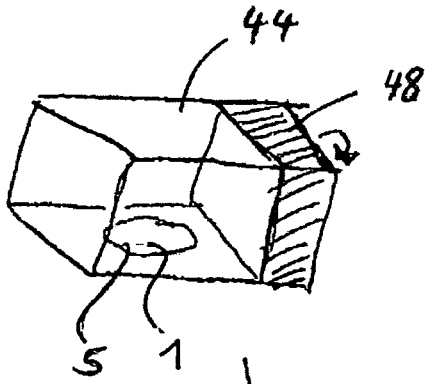
FIG. 9 [A-D] other exemplary embodiments of incubators with an encounter and contact mattress, with insert parts.
Figure 9B:
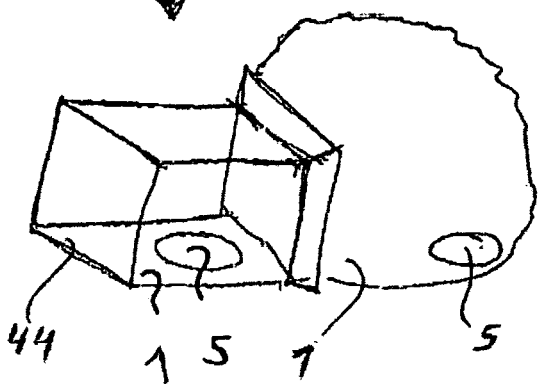
Figure 9C:
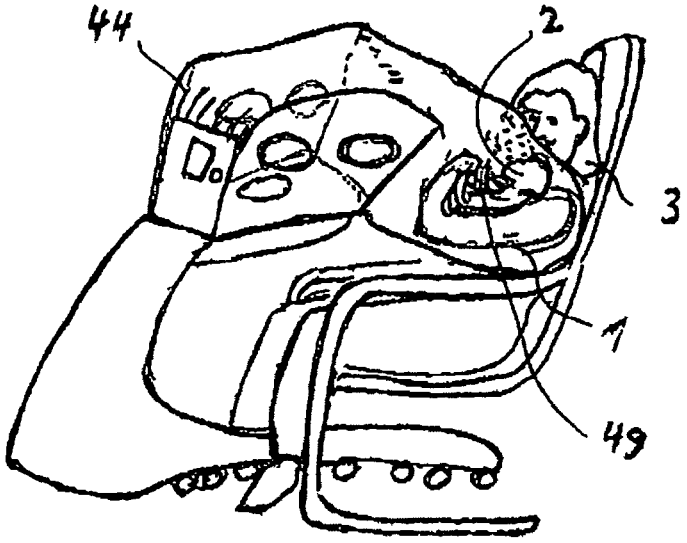
Figure 9D:
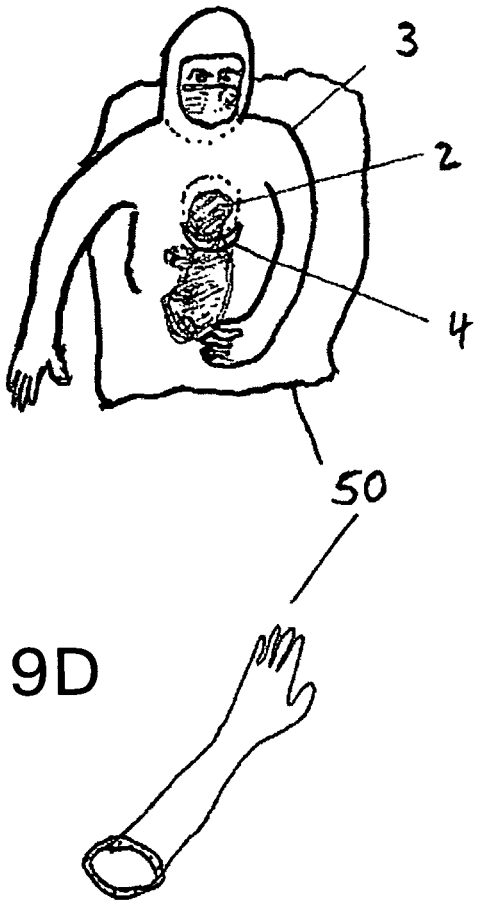
Figure 10A:
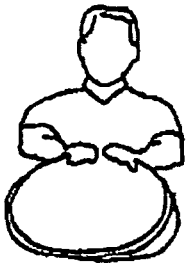
FIG. 10 [A-G] a special, collapsible embodiment of an encounter and contact mattress, with enclosing hood.
Figure 10B:
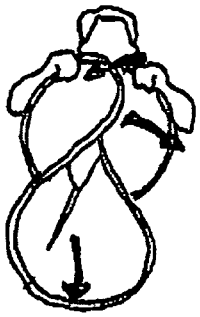
Figure 10C:
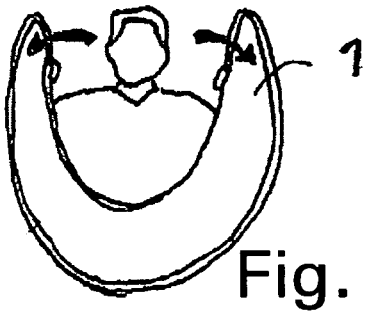
Figure 10D:
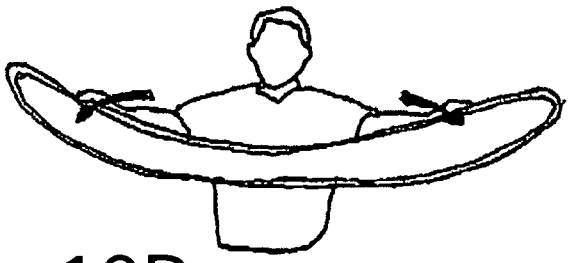
Figure 10E:
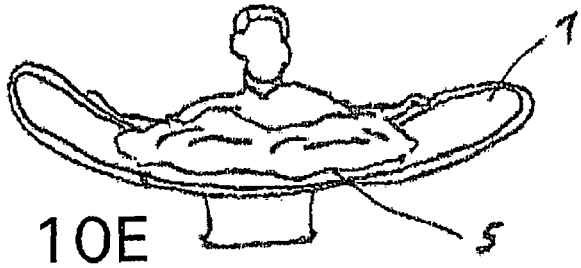
Figure 10F:
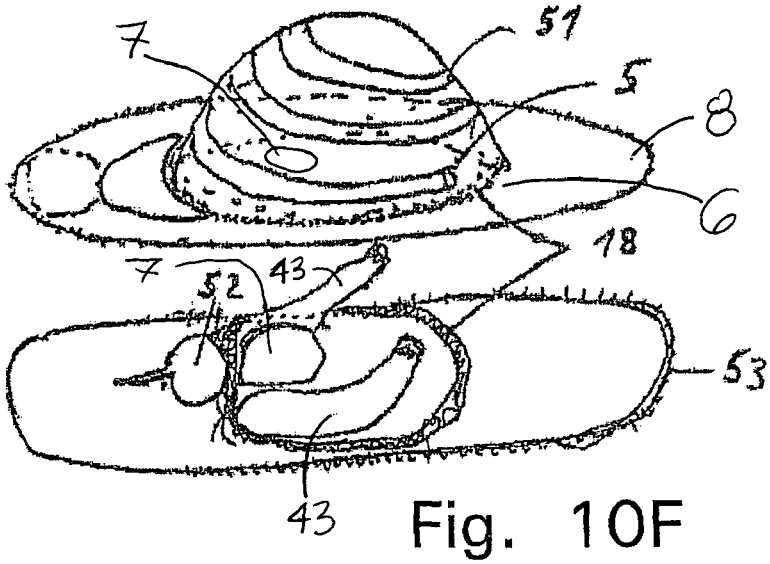
Figure 10G:
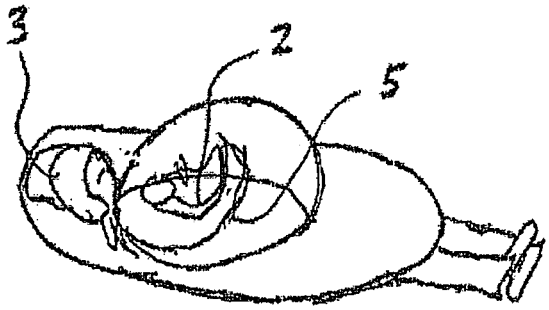

According to FIG. 7 [A-B], it would also be possible to replace the side flap or bottom flap of an incubator 44 with a suitable encounter or contact mattress 1, and to convert it to a mother-and-child incubator by means of bringing it to the mother, for example by means of a corresponding lifting mechanism or a construction affixed to a device. In this connection, the characteristics indicated with the reference symbols 45 and 46 represent supply and operating units for the incubator 44.

The incubator shown in FIG. 8 consists of an enclosure in the form of a hood, as is usual in incubators 44, whereby the contact mattress 1 is disposed on the bottom side of the incubator. Preferably, incubator 44 and contact mattress 1 form an integrated module.

In the transition to the housing of the incubator 44, in particular, cushion elements 47 are provided, so that, as shown in Section D, the edges of the hood of the incubator do not bring about any injuries when the incubator is set down, with the child lying inside it. The incubator 44 shown in FIGS. [9 A] and [9 B] has the possibility of pulling the contact mattress 1 that lies inside it into a wrapper, which can subsequently be joined to the incubator. Alternatively to this, it can also be provided that the incubator, as shown in FIG. [9 A], has a storage region for a balloon-like structure, which has already integrated the contact mat, so that, as in FIG. [9 B], the contact mattress is present in the storage region. The infant can therefore be pulled out of this flexible wrapper from the rigid incubator, but nevertheless the climatic condition that is necessary for the child to become well is maintained.

If the encounter and contact mattress according to the invention is introduced, as an encounter zone 5, under a tent-like enclosing fabric/film construction as in FIG. 10[A-G], under which a constant moist climate is maintained, then a simple form of an incubator is formed by this, which could find use for transport of contact person and child, or also as an emergency incubator. Likewise, it could find use as a disposable article (single-use), or serve as the basis for an incubator used in developing countries. A circumferential zipper 53 offers the possibility of affixing the mattresses to other objects.

The encounter and contact mattress 1 according to the invention is therefore a very flexible construction that also has a very small packing dimension. It has a strong edging, which is flexible, whereby the remaining part, particularly the transition region 6, towards the encounter region 5, consists of a flexible film 18 that is contact-friendly or skin-friendly. The encounter zone itself can be configured in different embodiments, as has already been described above. Thus, as shown in FIG. 10 [A-E], the mini-incubator can be set up in very simple manner. In general, depending on the configuration of the edging, this mini-incubator actually sets itself up.

The hood 51 described above has additional stabilization elements, so that corresponding stability is present, so that the hood structure is maintained. The contact mat itself is configured in such a manner that it also has cutouts 52 for the head region of the contact person, so that the contact person herself/himself can lie on at least a part of the encounter and contact mattress (the head), whereas the remaining body is covered, also in order to avoid that a corresponding loss of heat occurs. The encounter region 5 also includes sleeves 43 for insertion of the arms of the contact person 3.

Figure 11A:
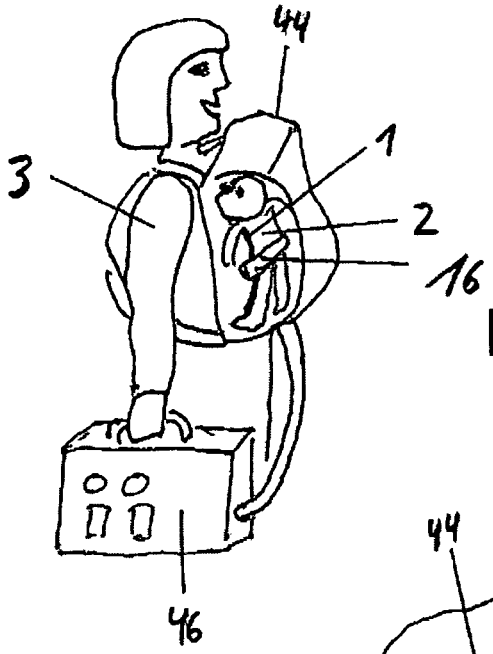
FIG. 11 [A-B] exemplary embodiments of the use of the encounter mattress (B with insert parts) in stable transport devices.
Figure 11B:
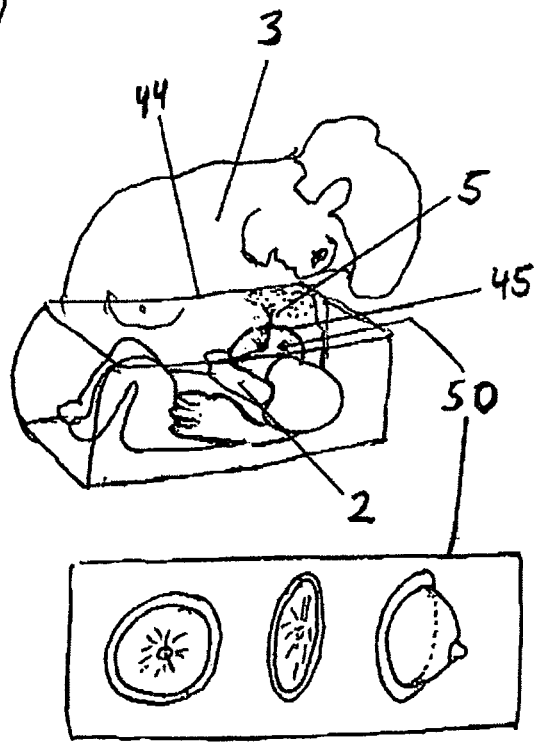

FIG. 11[A-B] to FIG. 14 give an outlook of possible new devices that only become possible with the use of a contact and encounter mattress.

FIG. 11[A-B] shows exemplary embodiments of the contact and encounter mattresses in stable portable devices: a portable incubator or a mattress construction with a carrying device, provided with a hood. In FIG. 11 [B], a nursing incubator is shown. Specific insert parts can furthermore facilitate the natural establishment of contact between contact person (generally the mother) and child, or actually make it possible. For example, the child can be held better by the contact person, by means of an inserted sleeve, as in FIG. 11 [B], in use in the incubator intended for nursing. Another benefit of complex insert parts as shown in FIG. 9 [D] (as a jacket with a hood, mouth protection, and gloves for attachment in an incubator, with precise fit) lies in that close contact with the child can be produced by means of the barrier, which is impermeable for dirt and germs, even in critical situations, which usually require isolation of the child.

Figure 12A:
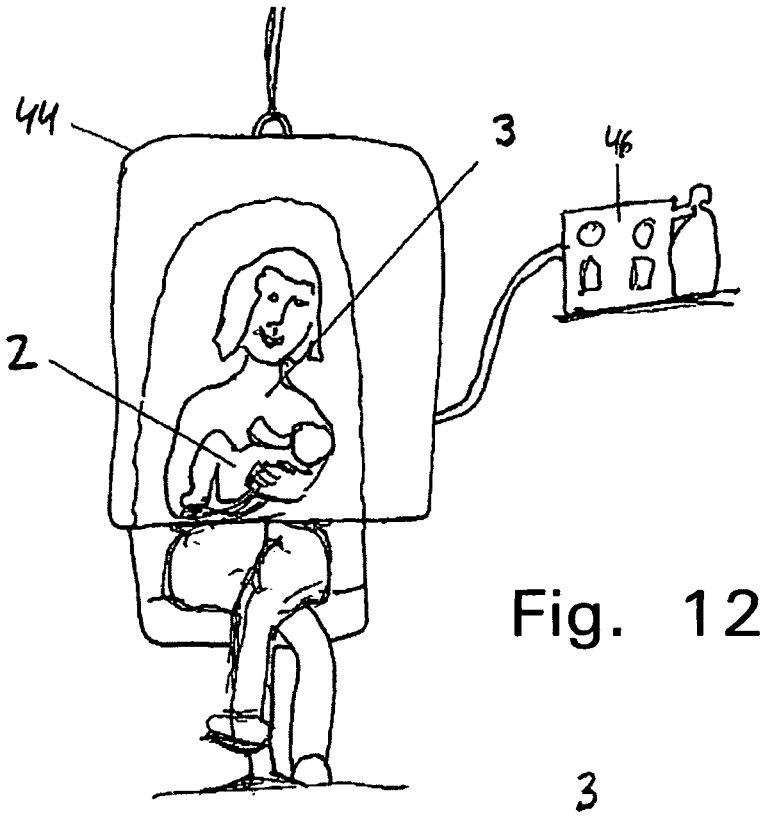
FIG. 12 [A-B] further exemplary embodiments of the encounter and contact mattress in hoods that partly or entirely enclose the contact person.
Figure 12B:
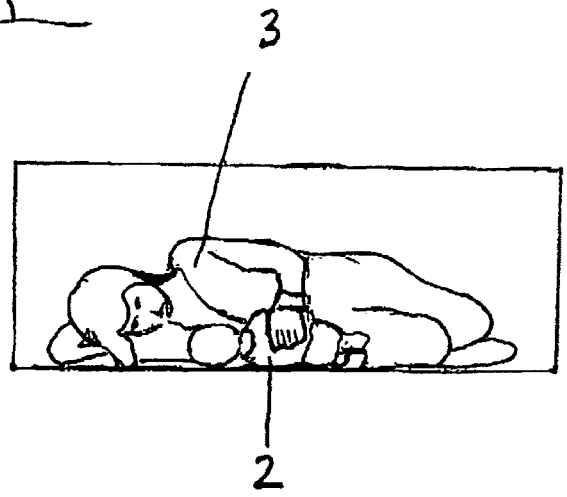
Figure 13A:
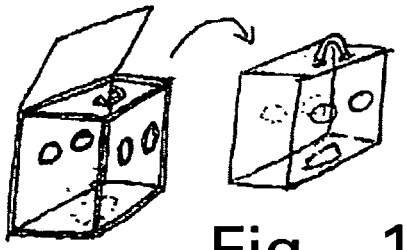
FIG. 13 [A-E] examples of technical solutions that support bringing the incubator or "hood device" to the contact person.
Figure 13B:
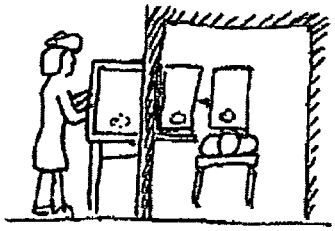
Figure 13C:
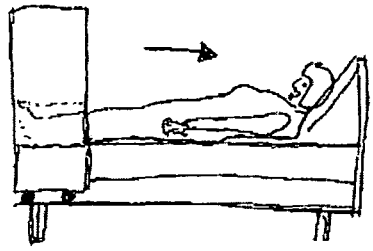
Figure 13C:
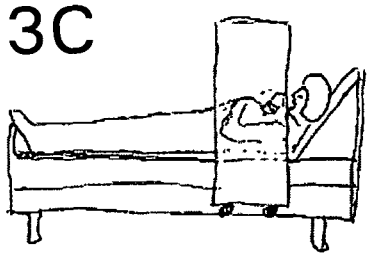
Figure 13D:
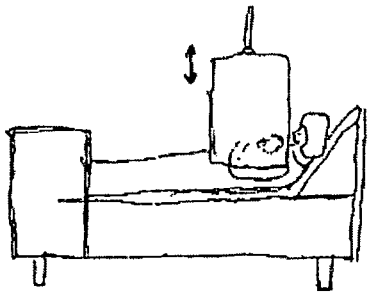
Figure 13E:
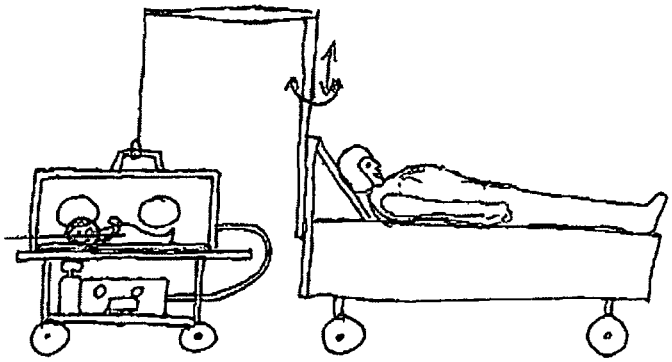
Figure 14A:
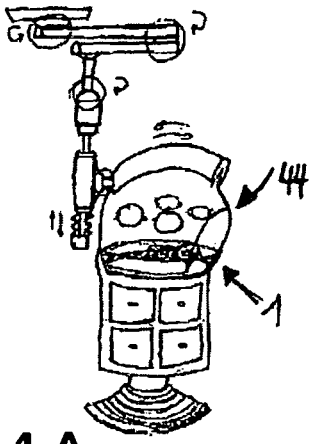
FIG. 14 [A-G] further exemplary embodiments of incubators or "hood devices" with an encounter and contact mattress.
Figure 14B:
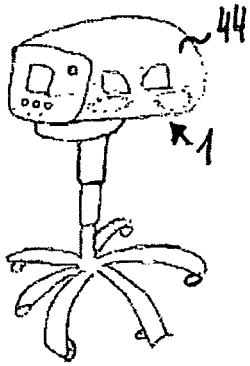
Figure 14C:
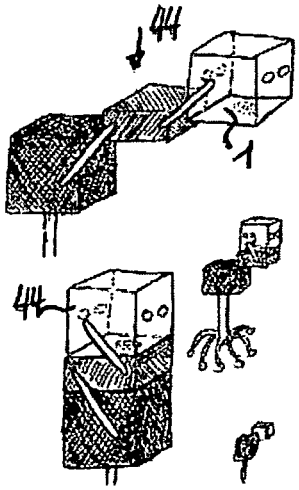
Figure 14D:
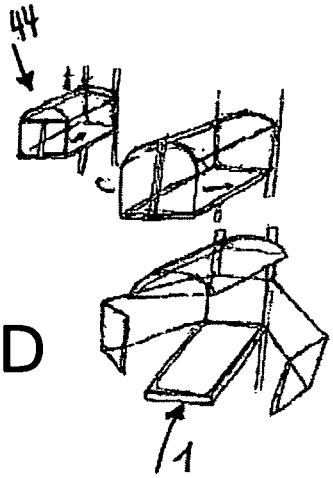
Figure 14E:
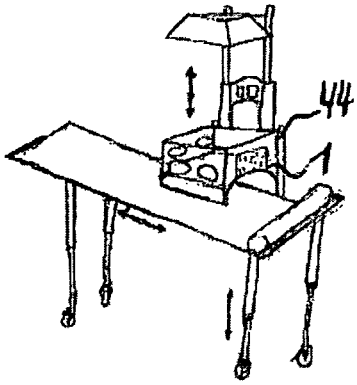
Figure 14F:
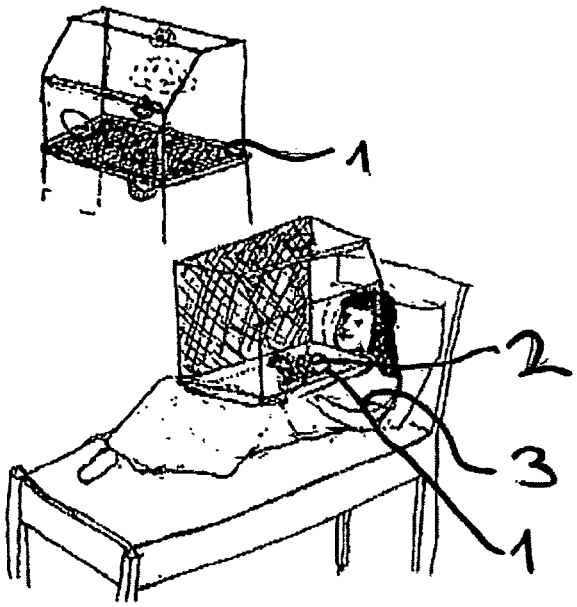
Figure 14G:
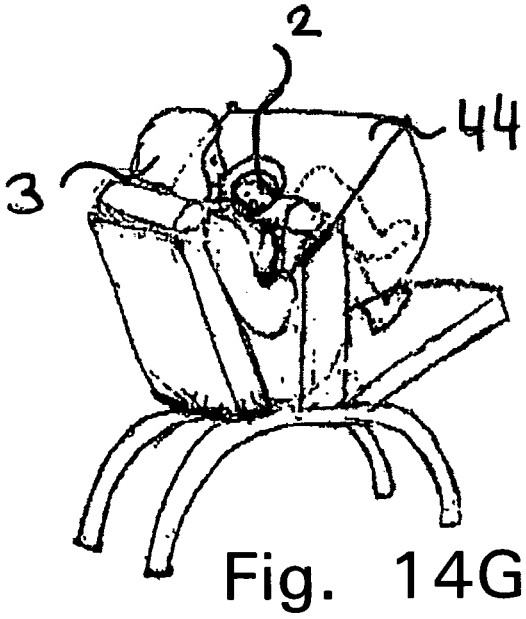

In the representations FIG. 12 [A-B], it is indicated that the encounter mattress can also be used in an incubator or in a hood construction that encloses the child and contact person in part or completely.

FIG. 13 [A-E] gives a selection of technical solutions that indicate the use of the new devices in everyday situations. In FIG. 14 [A-G], further form variants of devices that contain a contact or encounter mattress are shown.

In this connection, it might not be all that simple to differentiate between an incubator equipped with a contact and encounter mattress and an encounter mattress provided with a hood.

All the mattresses mentioned can be provided with additional functions, by means of the selection of a covering or the integration of permeable or impermeable films, or by means of configuration of the surface, for example by means of a coating or membrane. All the embodiment forms of the encounter and contact mattress described here can be used by themselves, or are suitable for finding use as intended, in other contexts, for example in an incubator, heating bed, or also integrated into corresponding clothing.

The support surface on the side facing the contact person can be provided with an embossed structure that carries away liquid, also in the examples last mentioned. Another possibility is a coating that is worked on or in (for example flocking), or a membrane that conducts away liquid, predominantly composed of breathable woven material, which is predominantly applied in fixed manner. In the case of thicker support surfaces, it would also be possible to extract the moisture by way of a chemical process installed in the functional zone (for example by means of a non-toxic granulate that withdraws moisture from the surroundings), or by means of another mechanism that conducts away moisture.

Aside from the uses described above, the invention can also be advantageously used for configurations of the following devices, in each instance:

- incubator for newborns (in the various known variations or those still to be developed);
- new device or type of device that only becomes possible on the basis of the invention 4*(and that could be called "KnagooBator," for example);
- heating beds and other intensive-care and palliative-care systems;
- with small packing dimensions, in ambulances, doctors' practices and midwife practices;
- in the bed of the mother or contact person;
- in articles of clothing, in backpacks and bags;
- in baby carriages and many more.

Even though the apparatus according to the invention is predominantly suitable and intended for newborns, particularly for premature babies, it is not restricted to this purpose of use, but rather can also be used for healthy babies and small children with a mother confined to bed (for example after a Caesarean delivery), for older children and the mother, or between children or between adults.

The invention claimed is:

1. An encounter and contact device comprising:

an encounter and contact mattress or pillow and a hood, wherein the encounter and contact mattress or pillow comprises at least one base body comprising a cloth or a blanket, the base body comprising a first functional side configured as a support surface for a baby or infant, a second functional side configured as a support for a contact person and disposed opposite from the first functional side, and at least an edge zone region, a transition region, and an encounter region, wherein the edge zone region, the transition region, and the encounter region each extend within a first base body plane of the base body, wherein the transition region completely surrounds the encounter region and extends in the first base body plane laterally from the encounter region and the edge zone region surrounds the transition region and extends in the first base body plane laterally from the transition region, and wherein the encounter region is configured to allow a transfer of at least one of tactile stimuli, acoustic stimuli, and heat through the base body from the first functional side to the second functional side and through the first base body plane such that physical contact between the baby or the infant and the contact person is enabled, wherein the hood is connected to the encounter and contact mattress or pillow and is configured to produce and/or maintain a moist or moist/warm microclimate within a region enclosed by the hood, and wherein at least one through-opening is provided in the encounter region, the at least one through-opening extending through the first base body plane from the first functional side to the second functional side and allowing skin-to-skin contact of skin of the baby or infant on the first functional side and skin of the contact person on the second functional side.

2. The encounter and contact device according to claim 1, wherein the hood is connected to at least-one of the encounter region and the transition region so that if the baby or infant is held on the first functional side of the base body and in the encounter region, the baby or infant is enclosed in the moist or moist/warm microclimate within the region enclosed by the hood.

3. The encounter and contact device according to claim 1, wherein the encounter region comprises film or fabric elements with the at least one through-opening, the film or fabric elements allowing the transfer of the tactile and/or the acoustical stimuli and/or the heat through the base body from the first functional side to the second functional side of the encounter and contact mattress.

4. The encounter and contact device according to claim 1, further comprising positioning elements and fixation apparatuses on the encounter and contact mattress or pillow for secure positioning of the baby or the infant.

5. The encounter and contact device according to claim 1, wherein the positioning elements and fixation apparatuses are affixed on the encounter and contact mattress or pillow in releasable manner.

6. The encounter and contact device according to claim 1, wherein the material in the encounter region is a film that is essentially thinner than the edge region and transition region, with regard to thickness.

7. The encounter and contact device according to claim 1, wherein material of the encounter region comprises sleeves, wherein arms of the contact person can be inserted into the sleeves.

8. The encounter and contact device according to claim 1, further comprising an incubator or a heating bed, wherein the encounter and contact mattress or pillow is a part of the incubator or the heating bed.

9. The encounter and contact device according to claim 1, further comprising a fixed frame or a holder, wherein the encounter and contact mattress or pillow is integrated into the fixed frame or the holder.

10. The encounter and contact device according to claim 1, wherein the edge zone region comprises a circumferential zipper allowing the base body to be affixed to another object.

11. The encounter and contact device according to claim 1, wherein the edge zone region or the transition region comprises a cutout allowing a head of the contact person to be inserted through the cutout and to be rested on the edge zone region or on the transition region on the first functional side of the base body while the remaining body of the contact person is disposed adjacent to the second side of the functional body.

* * * * *